US005426454A

United States Patent [19]

Hosono et al.

[11] Patent Number: 5,426,454

[45] Date of Patent: Jun. 20, 1995

[54] INK JET TYPE RECORDING HEAD DRIVING CIRCUIT

[75] Inventors: Satoru Hosono; Tomoaki Abe; Shuji Yonekubo; Minoru Usui; Masahiko Yoshida, all of Nagano, Japan

[73] Assignee: Seiko Epson Corporation, Tokyo, Japan

[21] Appl. No.: 996,620

[22] Filed: Dec. 24, 1992

[30] Foreign Application Priority Data

| | | | |
|---|---|---|---|
| Dec. 26, 1991 | [JP] | Japan | 3-345342 |
| Apr. 27, 1992 | [JP] | Japan | 4-108044 |
| Dec. 21, 1992 | [JP] | Japan | 4-356311 |

[51] Int. Cl.[6] ..... B41J 2/045

[52] U.S. Cl. ..... 347/9; 310/317

[58] Field of Search ..... 346/140 R; 310/316, 310/317; B41J 2/045; 347/9–12, 14

[56] References Cited

U.S. PATENT DOCUMENTS

| | | | |
|---|---|---|---|
| 4,044,297 | 8/1977 | Nobue et al. | 310/317 X |
| 4,126,867 | 11/1978 | Stevenson, Jr. | 346/140 R |
| 4,352,114 | 9/1982 | Kyogoku et al. | 346/140 R |
| 4,459,599 | 7/1984 | Ort | 346/140 R |
| 4,577,201 | 3/1986 | Murakami et al. | 346/140 R |
| 4,697,193 | 9/1987 | Hawkins | 346/1.1 |
| 4,717,927 | 1/1988 | Sato | 346/140 R |

FOREIGN PATENT DOCUMENTS

| | | | |
|---|---|---|---|
| 0159188 | 10/1985 | European Pat. Off. | B41J 2/045 |
| 0393602 | 10/1990 | European Pat. Off. | B41J 2/045 |
| 3508556 | 5/1984 | Germany | B41J 2/045 |
| 56-021861 | 2/1981 | Japan | B41J 2/045 |
| 57-116657 | 7/1982 | Japan | B41J 2/045 |
| 224218 | 5/1990 | Japan | B41J 2/045 |
| 4-01052 | 1/1992 | Japan | B41J 2/045 |

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet type recording head driving circuit comprises: a capacitor which is connected through a first switching transistor and a charging time constant adjusting resistor to a power source, and grounded through a second switching transistor and a discharging time constant adjusting resistor; and a current buffer through which the terminal voltage of the capacitor is applied to a pressure generating member scanning switch circuit. In the circuit, a first pulse for contracting a pressure generating member forming the recording head is applied to the first switching transistor, and a second pulse for expanding the pressure generating member is applied to the second switching transistor, so that the pressure generating member is contracted at a rate set by the capacitor and the charging time constant adjusting resistor, to supply ink into the pressure chamber of the recording head, and then it is expanded at a rate set by the capacitor and the discharging time constant adjusting resistor.

7 Claims, 9 Drawing Sheets

FIG. 9(a)
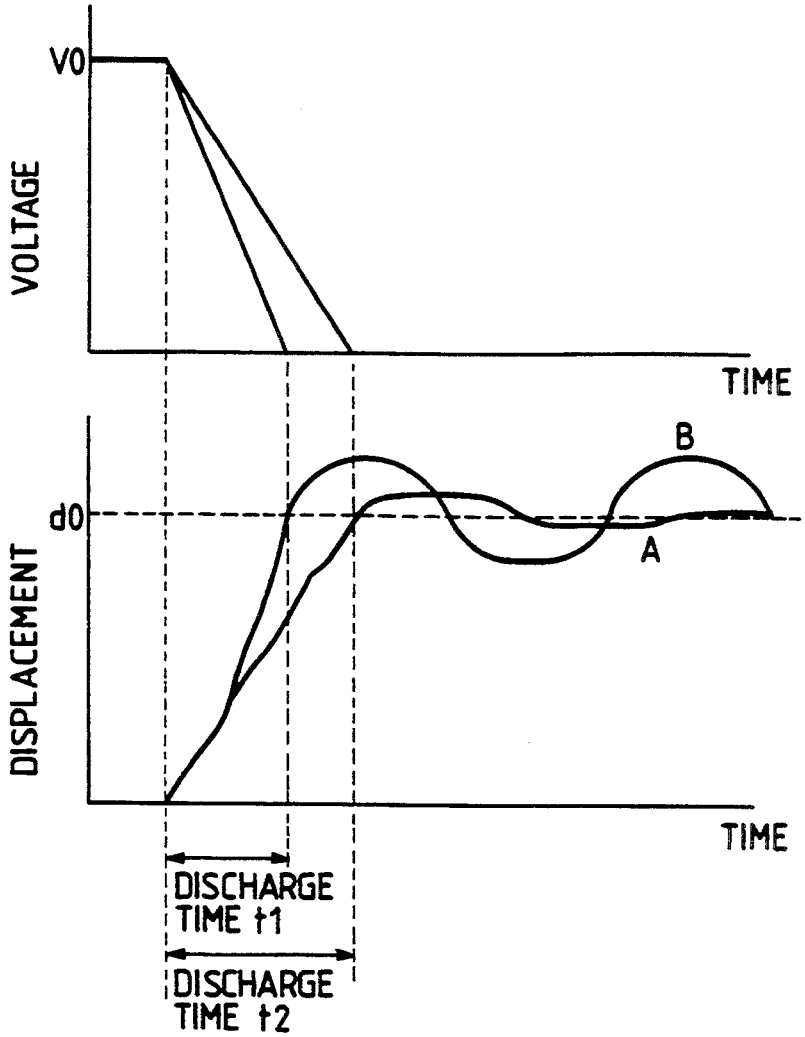
FIG. 9(b)
FIG. 9(c)
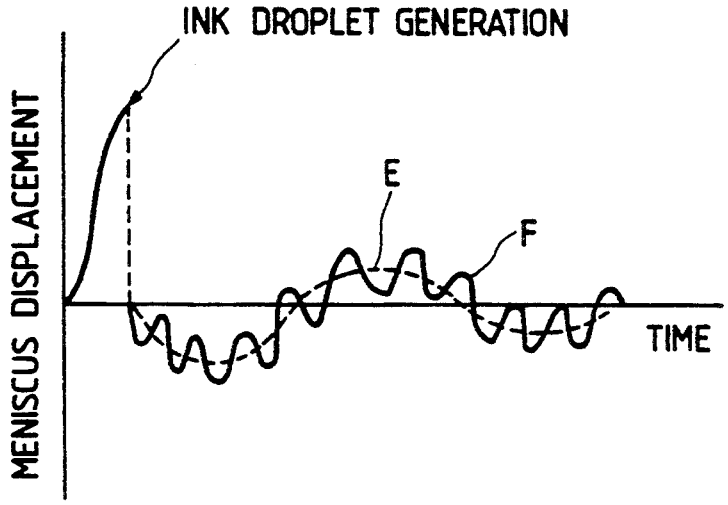

INK JET TYPE RECORDING HEAD DRIVING CIRCUIT

BACKGROUND OF THE INVENTION

1. Field of the Invention

This invention relates to a circuit for driving an ink jet type recording head in which a vibrating board forming a pressure chamber is displaced with a bar-shaped piezo-electric vibrator, so that the pressure chamber is compressed to jet ink droplets through nozzle openings (hereinafter referred to as "an ink jet type recording head driving circuit").

2. Description of the Prior Art

An ink jet type recording head for a recording apparatus is well know in the art which is so designed that, as disclosed for instance by Japanese Patent Application Publication No. 24218/1990, a disk-shaped piezo-electric vibrating plate is secured to an elastic board forming a pressure chamber. In the ink jet type recording head of this type, the displacement of the piezo-electric vibrator is small, and therefore it is essential that the pressure chamber is large in effective area. Therefore, in the recording head, the pressure chamber is located relatively far from the nozzle openings, and it is communicated with the latter through ink passageways. Hence, the recording head is unavoidably bulky. In addition, delicate adjustment is required for making the ink passageways uniform in fluid resistance.

In order to eliminate the above-described difficulties, for instance U.S. Pat. No. 4,697,193 has disclosed an ink jet type recording head in which a bar-shaped piezo-electric vibrator is abutted against a vibrating board forming a pressure chamber so as to compress and release the latter, so that ink droplets are formed by the longitudinal vibration of the piezo-electric vibrator.

The ink jet type recording head operating on the above-described longitudinal vibration employs a so-called "draw and strike" type driving system that, immediately before formation of a dot, a driving voltage is applied to the piezo-electric vibrator to contract the latter, and then the piezo-electric vibrator is discharged so that it is stretched to compress the pressure chamber thereby to form an ink droplet.

Employment of the "draw and strike" type driving system is advantageous in that the elastic energy stored in the piezo-electric vibrator or vibrating board in advance can be utilized, and in addition the ink can be positively led into the pressure chamber. However, it is disadvantageous in that, if the operating frequency of the piezo-electric vibrator is increased to increase the printing speed, then in formation of an ink droplet the meniscus of ink in the vicinity of the nozzle fluctuates in position, so that the ink droplet formed is changed in the velocity of flight and in size, and therefore the resultant print is low in quality.

In order to overcome the above-described difficulty, a driving method has been proposed in which the piezo-electric vibrator contracted is kept as it is until the meniscus returns to the original position and stops there, and thereafter the piezo-electric vibrator is stretched by discharging it. However, the driving system is still disadvantageous in that there is a wait time for restoration of the meniscus, which limits the printing speed.

The characteristic of printing with respect to temperature of the ink jet type recording head is liable to change when compared with those of other type recording heads such as a wire dot type recording head and a thermal transfer type recording head. Hence, the ink jet type recording head employs a temperature compensating circuit so that the driving voltage is controlled according to a detection signal provided by a temperature sensor. Accordingly, in this case, it is necessary to provide a power source circuit for driving the ink jet type recording head in addition to a power source circuit for a pulse motor or the like adapted to drive the printing mechanism; that is, the resultant printing machine is intricate in construction as much.

The piezo-electric vibrator of longitudinal vibration mode, being small in section, is advantageous in that a plurality of such piezo-electric vibrators can be readily arranged with high density. However, it is disadvantageous in that the piezo-electric vibrators arranged adjacent to one another suffer from mutual interference, which lowers the quality of the resultant print.

SUMMARY OF THE INVENTION

Accordingly, an object of this invention is to eliminate the above-described difficulties accompanying a conventional ink jet type recording head driving circuit.

More specifically, an object of the invention is to provide a ink jet type recording head driving circuit which controls the magnitude of a signal for driving a piezo-electric vibrator without depending on a supply voltage at the time of formation of an ink droplet, and sets the speeds of expanding and contracting the piezo-electric vibrator individually.

The foregoing object and other objects of the invention have been achieved by the provision of an ink jet type recording head driving circuit in which, according to the invention, a capacitor is connected through a first switching element and a charging time constant adjusting resistor to an electric power source, and grounded through a second switching element and a discharging time constant adjusting resistor, a terminal voltage of said capacitor is outputted through a current buffer, and the first switching element is controlled by a first pulse for contracting a piezo-electric vibrator, while the second switching element is controlled by a second pulse for expanding the piezo-electric vibrator.

With the recording head driving device, the pulse width of the first pulse is adjusted according to external conditions, the charging time constant adjusting resistor is so set as to provide a time constant with which the meniscus is not displaced, so that, with the position of the meniscus stabilized, a ball-shaped ink droplet is formed, and the discharging time constant adjusting resistor is set according to the free vibration period of the pressure generating member so that, after formation of an ink droplet, the residual vibrations of the piezo-electric vibrator and the pressure chamber are minimized in amplitude and in duration time.

The nature, principle, and utility of the invention will be more clearly understood from the following detailed description of the invention when read in conjunction with the accompanying drawings.

BRIEF DESCRIPTION OF THE DRAWINGS

In the accompanying drawings:

FIGS. 9(*a*) through 9(*c*) are graphical representations indicating changes in voltage for stretching a piezo-electric vibrator, residual vibrations of a pressure generating member, and displacement of a meniscus in the vicinity of a nozzle opening in the recording head, respectively;

DETAILED DESCRIPTION OF THE PREFERRED EMBODIMENT

One example of an ink jet type recording head driving circuit, which constitutes one embodiment of this invention, will be described with reference to the accompanying drawings.

Figure 2:
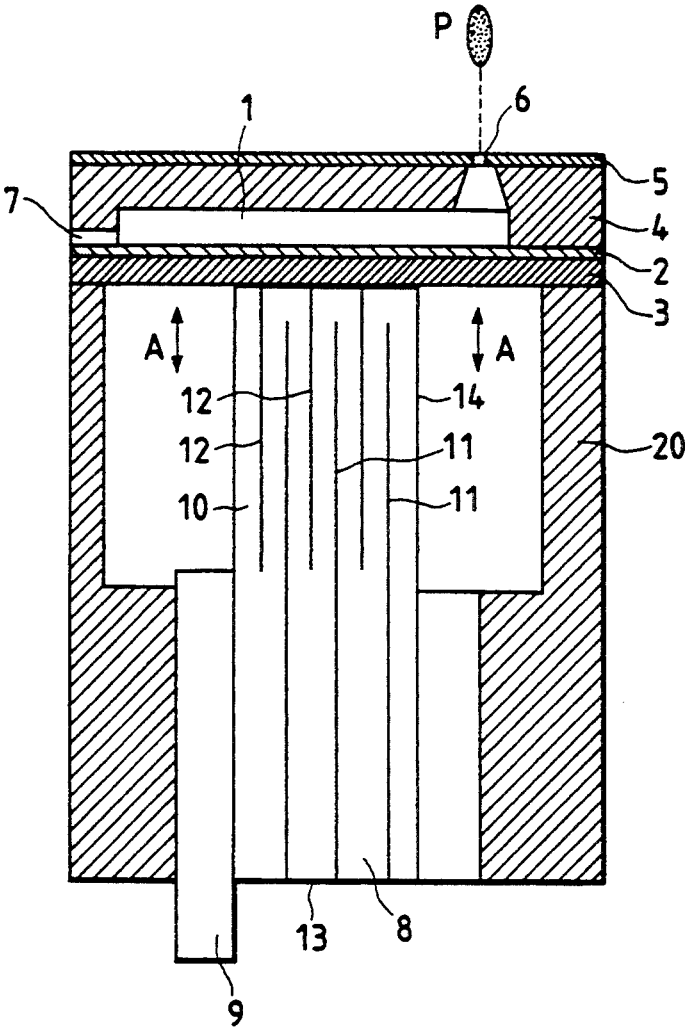
FIG. 2 is a sectional view of an ink jet type recording head of longitudinal vibration mode, to which the driving circuit of the invention is applied.

An ink jet type recording head, which is driven by the head driving circuit according to the invention, is as shown in FIG. 2. In FIG. 2, reference numeral 1 designates a pressure chamber which is defined by a vibrating board 3 covered with a film 2, a nozzle forming substrate 4 forming a predetermined space with the film 2, and a nozzle plate 5 bonded to the nozzle forming substrate 4. The pressure chamber 1 is communicated through an ink supplying inlet 7 to a common ink chamber (not shown). One end of a pressure generating member 8 is abutted against the other surface (rear surface) of the vibrating board 3 in such a manner that it opposes a nozzle opening 6. The other end of the pressure generating member 8 is fixedly secured through a substrate 9 to a base member 20.

In the recording head thus constructed, ink flowing into the pressure chamber 1 through the ink supplying inlet 7 is pressurized through the vibrating board 3 by the pressure generating member 8, thus being discharged in the form of ink droplets from the nozzle opening 6.

Figure 3:
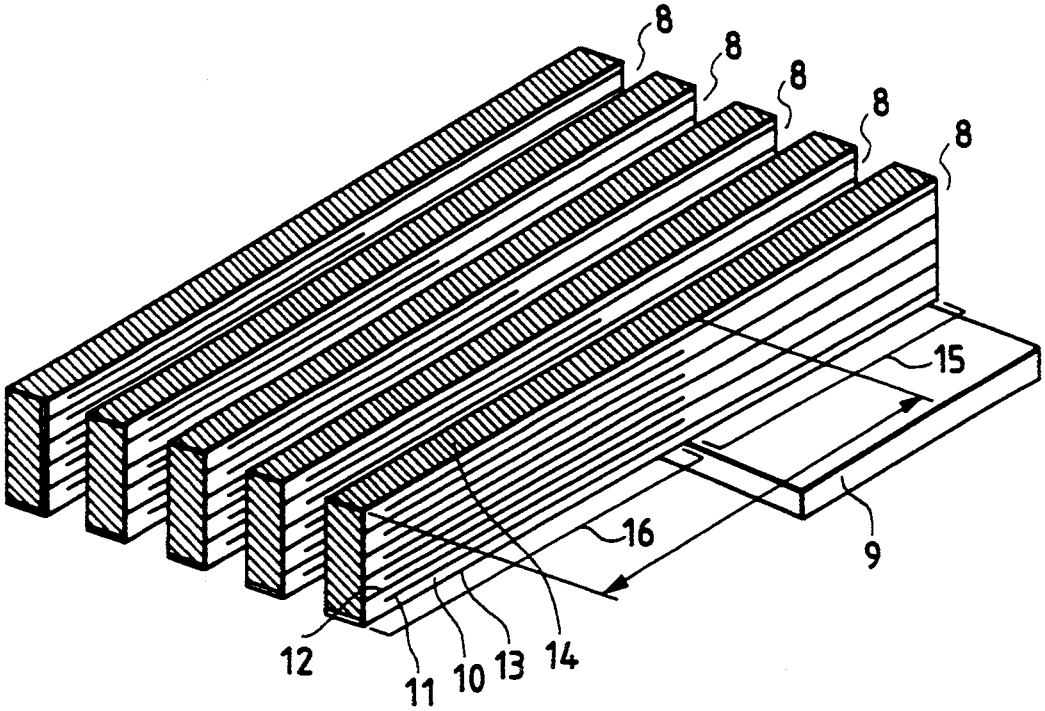
FIG. 3 is an enlarged perspective view showing an example of a piezo-electric vibrator unit forming the recording head shown in FIG. 2.

FIG. 3 shows one example of a piezo-electric vibrator unit forming the recording head shown in FIG. 2. The piezo-electric vibrator unit including the pressure generating members 8 is formed as follows: Piezo-electric layers 10, negative internal electrodes 11, and positive internal electrodes 12 are stacked in such a manner that a piezo-electric layer is sandwiched between a positive internal electrode and a negative internal electrode. The negative internal electrodes 11 are connected to a negative external electrode 13, while the positive internal electrodes 12 are connected to a positive external electrode 14. A plurality of the pressure generating members 8 thus formed are arranged in alignment with the nozzle openings 6 arranged at predetermined intervals, and fixedly secured to the substrate 9. The pressure generating members 8 thus secured each have a region referred to as "an inactive portion 15" in which he internal electrodes of one polarity are not provided (in the embodiment, the positive internal electrodes 12 being not provided), and a region referred to as "an active portion 16" where both the negative internal electrodes 11 and the positive internal electrodes 12 exist. The active portion 16 is extended like a cantilever a predetermined length from the substrate 8, thus serving as a free vibration portion.

When, in each pressure generating member 8, a voltage of the order of 30 volts is applied between the negative external electrode 13 and the positive external electrode 14, electric fields are formed in the piezo-electric vibrator layers 10, so that only the active portion 16 is expanded and contracted as indicated by the arrow A. In this operation, the inactive portion 15 supported by the substrate 9 is not deformed.

Figure 4:
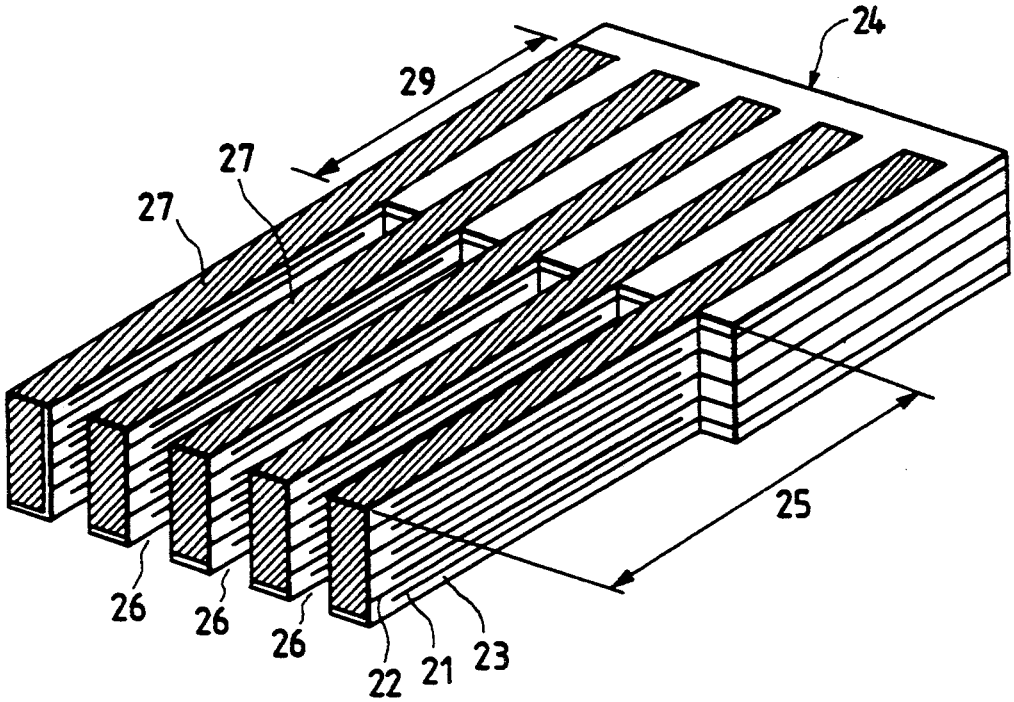
FIG. 4 is an enlarged perspective view showing another example of the piezo-electric vibrator unit.

In the above-described piezo-electric vibrator unit, the pressure generating members 8 are individually fixedly secured to the substrate 9. However, the piezo-electric vibrator unit may be formed as shown in FIG. 4. That is, first a laminated block 24 is formed by stacking negative internal electrodes 21, positive internal electrodes 22 and the piezo-electric layers 13 in the same manner. Thereafter, slits 26, 26, 26, . . . are cut in the block 24 so as to form active portions 25, namely, piezo-electric vibrator bodies 27, thus leaving inactive portions. That is, the block 24 is cut in the form of a comb. The recording head thus formed has the same effects as the one shown in FIG. 3, and requires no fixing substrate 9 (FIG. 3).

Figure 1:
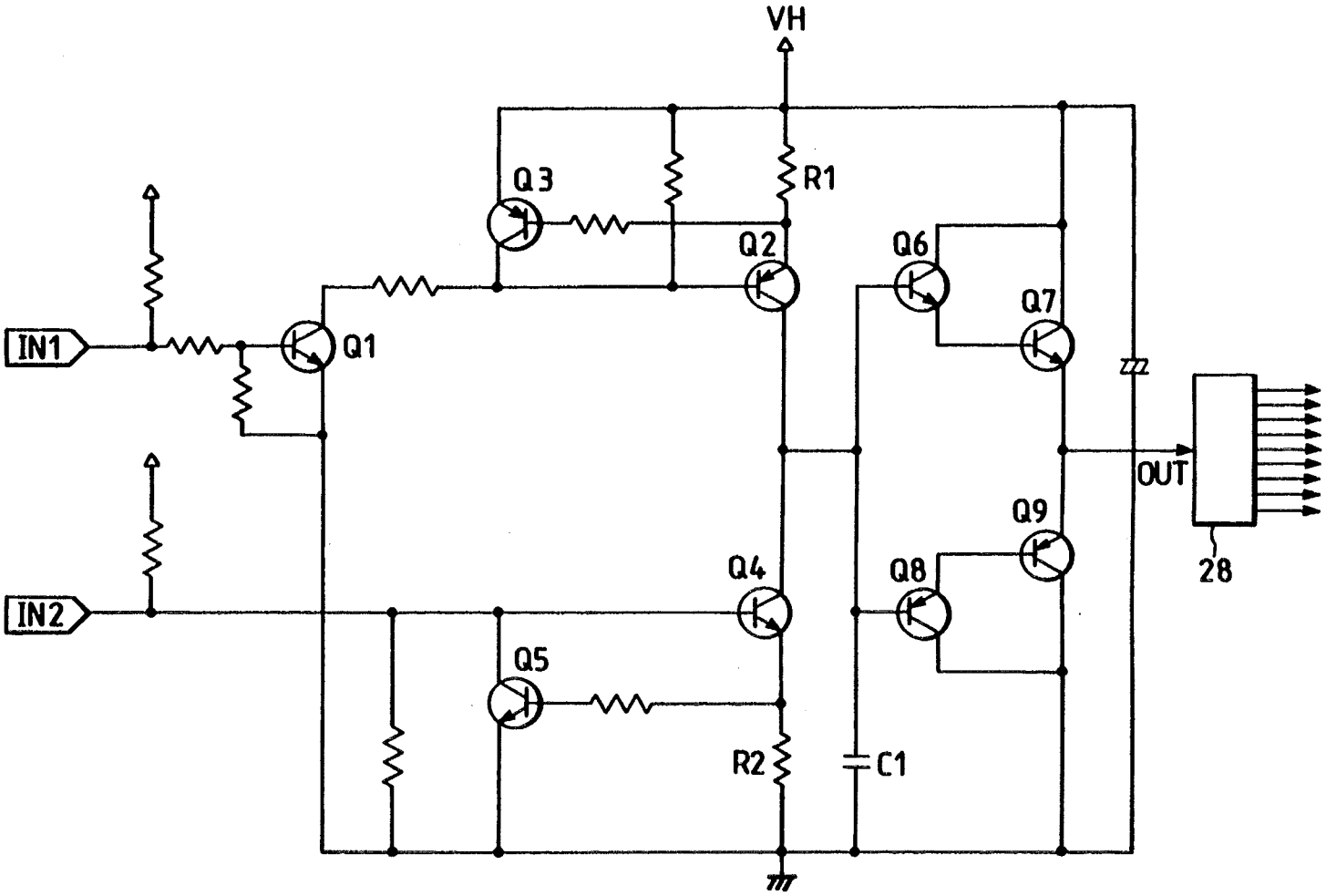
FIG. 1 is a circuit diagram, partly as a block diagram, showing an ink jet type recording head driving circuit, which constitutes a first embodiment of this invention.

One example of the ink jet type recording head driving circuit according to the invention is as shown in FIG. 1.

In FIG. 1, reference character IN1 designates a printing preparatory signal input terminal; and IN2, a printing signal input terminal. As shown in in FIG. 6, pulse-like signals are applied to those input terminals with printing timing. Reference character Q1 designates a level adjusting transistor, the base electrode of which is connected to the input terminal IN1. The collector electrode of the transistor Q1 is connected to the base electrode of a first switching transistor Q2. The emitter electrode of the transistor Q2 is connected through a time constant adjusting resistor R1 and a terminal VH to a power source, and the collector electrode thereof is grounded through a time constant adjusting capacitor C1. Reference character Q3 designates a constant current transistor, the emitter electrode of which is connected to the power source terminal VH. The collector electrode of the transistor Q3 is connected to the collector electrode of the level adjusting transistor Q1, and the base electrode of the transistor Q3 is connected through the time constant adjusting resistor R1 to the power source terminal VH.

The input terminal IN2 is connected to the base electrode of a second switching transistor Q4, the collector electrode of which is connected to the time constant adjusting capacitor C1. The emitter electrode of the transistor Q4 is connected through a second time constant adjusting resistor R2.

Further in FIG. 1, reference character Q5 designates a constant current transistor Q. The collector electrode of the transistor Q5 is connected to the input terminal IN2, the emitter electrode thereof is grounded, and the base electrode thereof is connected through the second time constant adjusting resistor R2.

Reference characters Q6, Q7, Q8 and Q9 designate transistors which form a current buffer for amplifying current in charging and discharging the capacitor C1. In the embodiment, the transistors Q6 and Q7 and the transistors Q8 and Q9 are Darlington-connected. The current buffer is able to simultaneously drive all the pressure generating members 8 of the ink jet type recording head to be driven.

The current buffer has an output terminal OUT which is connected to a switching circuit 28, which is connected to all the pressure generating members 8. The switching circuit 28 is designed as follows: In response to the printing signal, the switching circuit 28 is turned on and off so as to supply currents provided by the transistors Q6, Q7, Q8 and Q9 forming the current buffer selectively to the pressure generating members 8 which are to form ink droplets.

The switching circuit 28 is formed with switching elements only; that is, it needs no current adjusting means. Therefore, it is light in weight and small in size. Hence, it can be mechanically disconnected from a driving voltage generating circuit, and mounted on the carriage of the recording head by connecting it through a flexible cable thereto.

Figure 5:
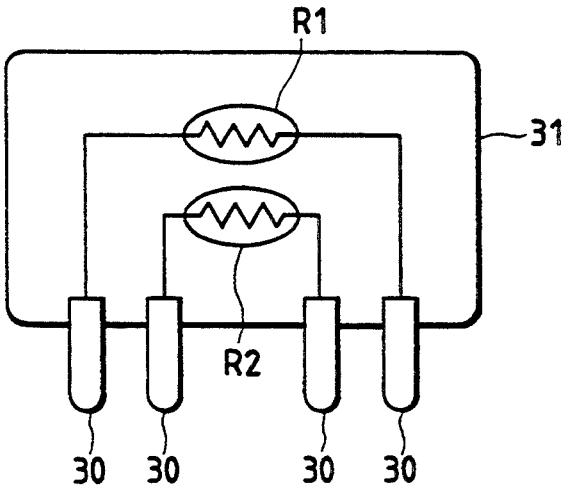
FIG. 5 is an explanatory diagram showing time constant adjusting resistors in the driving circuit shown in FIG. 1.

The time constant adjusting resistors R1 and R2 may be provided as shown in FIG. 5. That is, the resistors R1 and R2 are fixedly mounted on a substrate 31 having terminals 30 which are connected to lead wires. Thereafter, those components are molded into one unit. In this connection, it is desirable that a plurality of those units different in resistance are prepared in the above-described manner. That is, if a number of the units are available, then merely by exchanging the unit, a time constant can be set which is most suitable for the ink discharging characteristic of an ink jet type recording head. This contributes to simplification of the printing operation.

Figure 6:
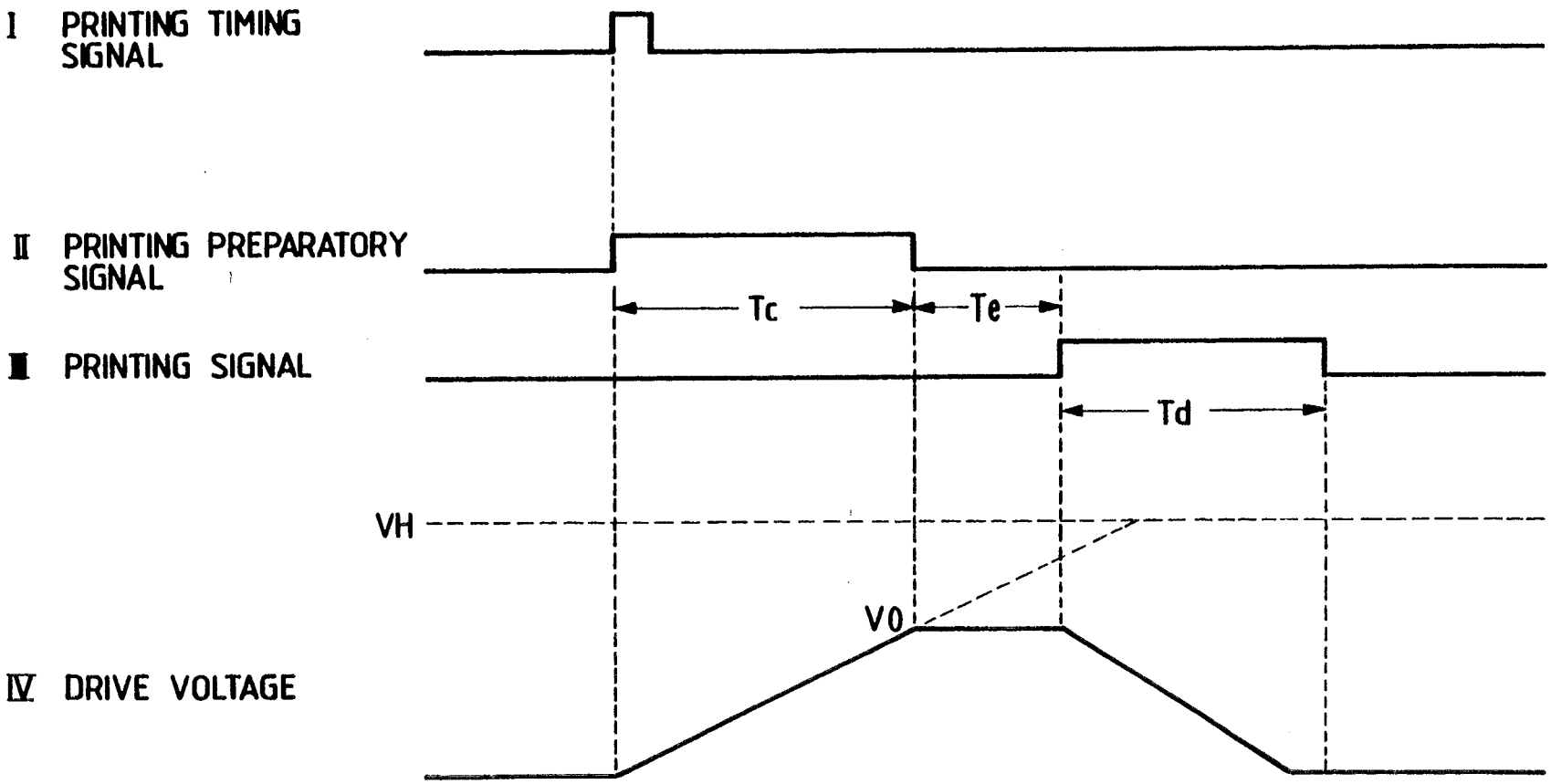
FIG. 6 is a waveform diagram for a description of the operation of the driving circuit according to the invention.
Figure 7A:
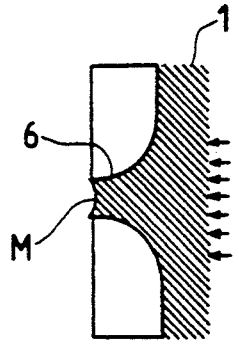
FIGS. 7(*a*) and 7(*d*) are explanatory diagrams for a description of relationships between the positions of a meniscus and the configurations of an ink droplet with a pressure chamber compressed.
Figure 7B:
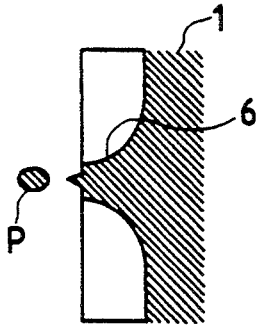
Figure 7C:
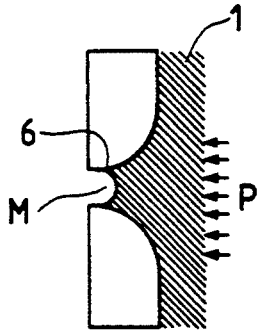
Figure 7D:
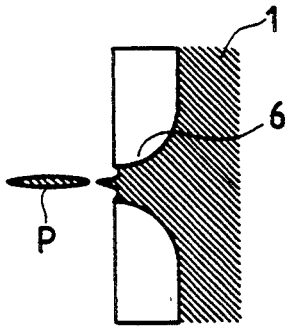

The operation of the above-described driving circuit (FIG. 1) will be described with reference to a waveform diagram of FIG. 6 in more detail.

When a printing timing signal (the part I of FIG. 6) for forming one dot is applied by a host, in synchronization with the printing timing signal a printing preparatory signal (the part II of FIG. 6) having a pulse width Tc is produced. The pulse width Tc is determined according to a charge time. When the printing preparatory signal is applied to the input terminal IN1, the level adjusting transistor Q1 is turned on, and accordingly the first switching transistor Q2 is also turned on. As a result, the supply voltage VH is applied through the time constant adjusting resistor R1 to the capacitor C1, and the latter C1 is charged with a time constant determined by the resistance of the resistor R1 and the capacitance of the capacitor C1.

The time constant adjusting resistor R1 is shunted with the constant current transistor Q3, and therefore the voltage across the resistor R1 is substantially equal to the base-emitter voltage of the transistor Q3. Hence, current flowing in the capacitor C1 is constant, not changing with time. Thus, the rise gradient $\tau 1$ of the terminal voltage (IV) of the capacitor C1 is as follows:

$$\tau 1 = |VBE1|/(R1 \times C1)$$

where R1 is the resistance of the resistor R1, C1 is the capacitance of the capacitor C1, and VBE1 is the base-emitter voltage of the constant current transistor Q3.

When the time corresponding to the pulse width Tc of the printing preparatory signal has passed, the terminal voltage of the capacitor C1 is raised to a voltage V0. At this time instant, the printing preparatory signal is set to "L (low)" level, so that the level adjusting transistor Q1 is turned off, and accordingly the first switching transistor Q2 is turned off. As a result, the voltage of the capacitor C1 is maintained at V0 ($=\tau \times Tc$).

When a predetermined period of time Te has passed from termination of the printing preparatory signal; that is, when time has passed to the extent that the switching transistors Q2 and Q4 are not short-circuited, a printing signal (the part III of FIG. 6) is applied to the input terminal IN2. The printing signal has a pulse width Td which is long enough to discharge the capacitor C1 to substantially zero potential. The printing signal thus applied turns on the second switching transistor Q4, as a result of which the capacitor C1 is discharged through the time constant adjusting resistor R2. At the same time, the constant current transistor Q5 is turned on. Hence, similarly as in the case of the above-described first constant current transistor Q3, the terminal voltage of the second time constant adjusting resistor R2 becomes the base-emitter voltage VBE2 of the transistor Q5. Thus, the terminal voltage (IV) of the capacitor C1 is linearly decreased with a predetermined gradient.

That is, the fall gradient $\tau 2$ of the terminal voltage (IV) of the capacitor C1 is as follows:

$$\tau 2 = -|VBE2|/(R2 \times C1)$$

where R2 is the resistance of the second time constant adjusting resistor R2, C1 is the capacitance of the capacitor C1, and VBE2 is the base-emitter voltage of the constant current transistor Q5.

When the printing signal is terminated with the lapse of time Td, the second switching transistor Q4 is turned off, and the change in terminal voltage of the capacitor C1 is suspended. The pulse width Td of the printing signal is much larger than the discharge time constant which is determined by the capacitance C1 and the resistance R2, and therefore no charge remains in the capacitor C1.

The voltage which changes with a predetermined rise rate and fall rate which are determined by the time constant adjusting resistors R1 and R2 and the capacitor C1 is amplified by the transistors Q6, Q7, Q8 and Q9 forming the current buffer, and applied through the switching circuit 28 to the piezo-electric vibrators 8 forming the ink jet type recording head (FIG. 2).

Thus, by turning on and off the switching elements of the switching circuit 28 in synchronization with the printing signal, the voltage signals from the common driving voltage generating circuit, which have one and the same waveform, can be applied selectively to the plurality of pressure generating elements 8. The pulse width Tc of the printing preparatory signal, and the pulse width Td of the printing signal depend on the structure of an ink jet type recording head employed, and the viscosity of ink selected; however, the central value of the pulse width Tc is of the order of 120 μs (micro-seconds), and that of the pulse width TD is of the order of 6 μs. Those values may be adjusted within 10% when necessary.

The piezo-electric vibrators of a recording heads are picked up from one and the same lot, and therefore the nozzles are equal in ink discharging characteristic. On the other hand, frequently the recording heads manufactured are different in ink discharging characteristic because of manufacturing errors of their pressure chambers. The ink discharging characteristic thus deviated from one another are, in general, corrected by adjusting the waveform of the voltage driving the ink jet type recording head.

With the above-described driving circuit, the rise characteristic, namely, the rate of expansion of the pressure chamber, and the fall characteristic, namely, the rate of contraction of the pressure chamber 1 can be individually and readily adjusted with time constant adjusting resistor R1 and the time constant adjusting resistor R2, respectively. The maximum voltage of the capacitor C1 depends on the charge time, and therefore it can be adjusted by changing the pulse width Tc of the printing preparatory signal.

Hence, the driving circuit of the invention, unlike the conventional driving circuit, needs no power source circuit which is maintained at a certain voltage. For instance, it can utilize the output power of a pulse motor driving DC power source which is relatively large in voltage variation. That is, in this case, the pulse width Tc of the printing preparatory signal can be made constant by automatically controlling it according to the supply voltage. This means that one and the same power source may be used for both the ink jet type recording head and the pulse motor or the like, with results that the printing machine is reduced both in size and in manufacturing cost as much.

The voltage having the predetermined waveform, generated by the driving circuit, is applied through the switching circuit 28 selectively to the piezo-electric vibrators in the ink jet type recording head. Therefore, the driving means can be formed with switching means only, which contributes greatly to simplification of the structure of the printing machine and to reduction of the weight of the same. Hence, in the case where the driving circuit is mounted on the stationary system thereof, and the driving means is mounted on the carriage, the greater part of the leads in a flexible cable connected between the driving circuit and the driving means may be small in current capacity, to such an extent that they can transmit a scanning signal in maximum. In this case, the connecting cable can be miniaturized as much.

When the pressure generating members 8 are contracted in response to the printing preparatory signal, the pressure chamber 1 is expanded, so that the ink is supplied through the ink supplying inlet 7 to the pressure chamber 1. The expansion of the pressure chamber 1 acts to retract a meniscus of ink formed near the nozzle opening 6.

After the ink has been supplied to the pressure chamber 1, the pressure generating members 8 are expanded to compress the pressure chamber 1, so that ink droplets are jetted from the nozzle openings 6. In the case when the pressure chamber is compressed, the position of the meniscus of ink and the configuration of the ink droplet relates greatly to each other. Hence, the quality of a print formed by the printing machine depends on the timing of compressing the pressure chamber.

That is, when the pressure chamber 1 is contracted under the condition that the meniscus M is positioned near the nozzle opening 6 (FIG. 7(*a*)) as in the case where the pressure chamber is maintained stopped, the ink droplet P jetted from the nozzle opening is in the form of a ball as shown in FIG. 7(*b*). On the other hand, when the pressure chamber is contracted under the condition that, as shown in FIG. 7(*c*), the meniscus M is retracted from the nozzle opening 6, the ink droplet P jetted from the nozzle opening 6 has a cylindrical shape, being elongated in the direction of flight, as shown in FIG. 7(*d*). When the ink droplet P like a ball reaches the recording medium, it will form a substantially circular dot; whereas when the ink droplet P like a cylinder will form a dot which is not circular, thus lowering the quality of the resultant print.

When the pressure chamber 1 is expanded, the meniscus M is retracted from the nozzle opening; that is, it is moved towards the pressure generating member 8. This is due to the fact that the loss of pressure at the ink supplying inlet 7 is larger than the surface tension of the ink at or near the nozzle opening 6. Hence, it is necessary to draw the ink into the pressure chamber 1 at a velocity that maintains the loss of pressure at the ink supplying inlet 7 smaller than the surface tension of the ink near the nozzle opening.

Figure 8:
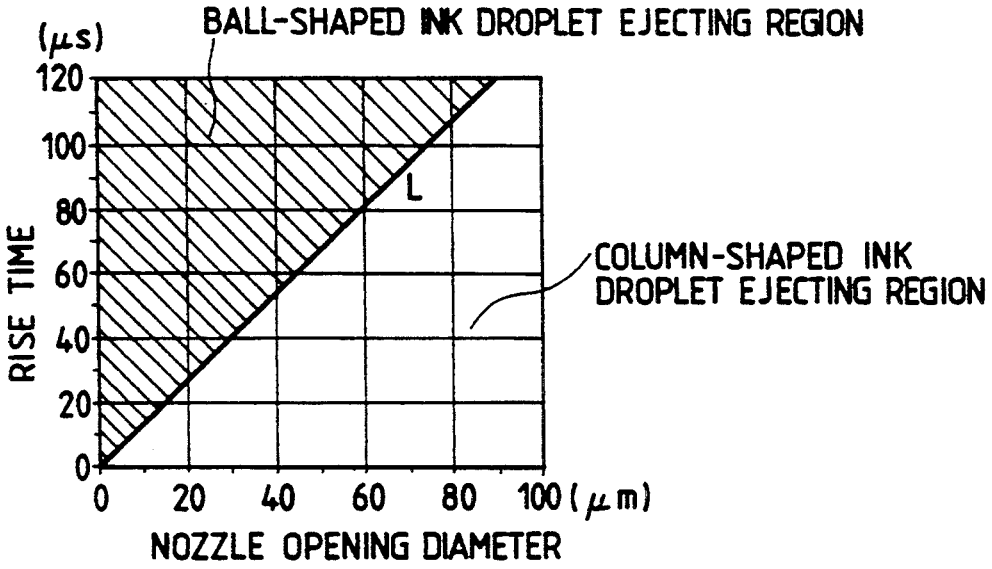
FIG. 8 is a graphical representation indicating nozzle opening sizes with rise speeds in stretching a piezo-electric vibrator together with configurations of ink droplets formed.

The surface tension of the ink near the nozzle opening 6 depends on the size of the latter 6, and the viscosity of the ink. However, typically stated, as shown in FIG. 8, when the ink chamber is expanded at a rate lower than that which is obtained from a straight line L representing the proportional relation between the size of the nozzle opening and the time of contraction of the piezo-electric vibrator; i.e., the rise time of the printing preparatory signal, than a ball-shaped ink droplet is produced. However, increasing the rise time is limited to a certain value, because if the rise time is excessively increased, then the printing speed is lowered.

With the recording head driving circuit of the invention, the rise time can be set to a desired value with the timing constant adjusting resistor R1, as was described above. Hence, the recording head driving circuit can be applied to a variety of ink jet type recording heads different in specification by determining the resistance of the time constant adjusting resistor R1 in accordance with the characteristic of given ink jet type recording head, such as the size of the nozzle opening and the viscosity of the ink employed.

Upon completion of the supply of ink to the pressure chamber 1, in order to form an ink droplet, the pressure chamber is compressed; that is, the pressure generating member 8 is expanded. If, in this case, the pressure generating member 8 is made up of a piezo-electric vibrator of longitudinal vibration mode, then since the pressure generating member 8 is high in rigidity, a residual vibration is produced which has a relatively long residual time corresponding to the resonance frequency thereof, and is large in amplitude.

That is, as shown in FIG. 9(*a*), when the pressure generating member 8 charged to a voltage V0 is discharged with the discharge time Td changed, the residual vibration of the pressure generating member 8 is changed in pattern according to the discharge time Td. That is, a free vibration of an intrinsic vibration period Tf takes place about the position D0 where the end of the pressure generating member is positioned when no voltage is applied thereto. In this case, the amplitude and the duration time of the free vibration depend greatly on the discharge time as indicated at (A) and (B) in FIG. 9(*b*).

On the other hand, the ink in the pressure chamber 1 vibrates in synchronization with the vibration of the pressure chamber itself. The free vibration period of the pressure chamber 1, as indicated at (E) in FIG. 9(*c*), is longer than that of the pressure generating member 8. Hence, the vibration of the pressure generating member is superposed on that (E) of the ink itself, so that the meniscus near the nozzle opening moves as indicated at (F) in FIG. 9(*c*). That is, the residual vibration of the pressure generating member 8 is small in amplitude; however, when it is added to the vibration of the ink itself, the amplitude of the vibration of the meniscus cannot be disregarded with a time level which is of the order of the free vibration period of the pressure generating member 8. When the meniscus is vibrated at a high speed of the order of the free vibration period of the pressure generating member 8, ink droplets are produced like mist, thus affecting the wettability of the vicinity of the nozzle opening. The wettability of the vicinity of the nozzle opening affects the flying velocity and the configuration of the ink droplet. As a result, the print is affected in quality.

Figure 10:
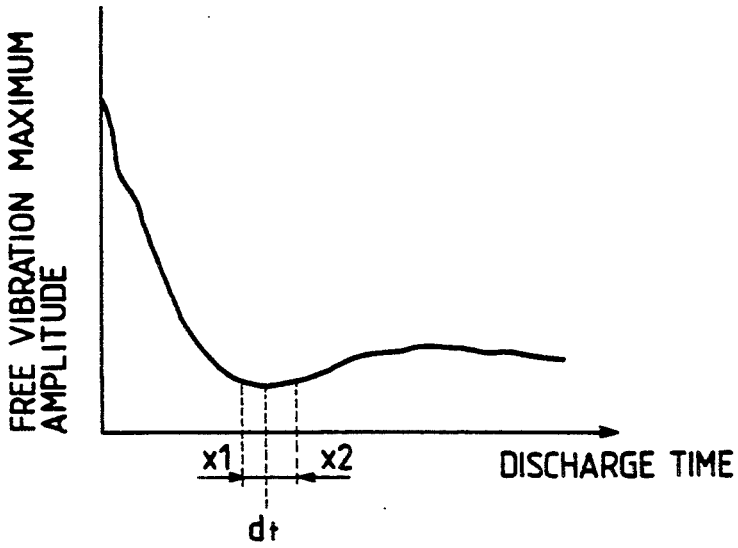
FIG. 10 is also a graphical representation indicating voltage for stretching the piezo-electric vibrator with maximum free vibration amplitude of a pressure chamber forming member after formation of an ink droplet.

It has been confirmed through experiments that the relationships between the amplitude of the residual vibration of the pressure generating member 8 and the discharge time Td are shown in FIG. 10, and the amplitude of the residual vibration is minimum with the discharge time Dt corresponding to the free vibration period of the piezo-electric vibrator.

As the amplitude of the residual vibration decreases, the meniscus, after formation of an ink droplet, is stabilized quickly as much, and the aforementioned wettability can be maintained constant. Hence, the repetitive driving frequency can be increased, and the printing quality can be maintained constant.

As is seen from FIG. 10, the maximum amplitude, and the maximum velocity are larger when the discharge time is shorter than the natural period dt. Therefore, for certainty, the discharge time should be set to a value longer than the natural vibration period. For instance, in the case where the free vibration period dt of the pressure generating member 8 is 6.5 $\mu$s, the discharge time should be set to a value in a range of from 6.3 $\mu$s ($=dt-x1=6.5-0.2$) to 6.9 $\mu$s ($=dt+x2=6.5+0.4$).

Figure 11:
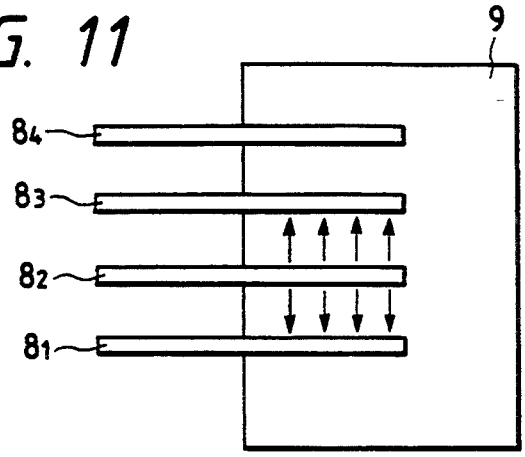
FIG. 11 is an explanatory diagram showing how the vibration of one pressure generating member propagates through other pressure generating members.

In the ink jet type recording head, a number of pressure generating members $8_1$, $8_2$, $8_3$ and $8_4$ are arranged at intervals of an extremely short distance as shown in FIG. 11. Therefore, a compressional wave produced in the active region of one pressure generating member $8_2$ propagates through the inactive region and through the substrate 9, so that the pressure generating members $8_1$ and $8_3$ adjacent thereto resonate with it. This phenomenon occurs significantly in proportion to the increasing recording density.

Figure 12:
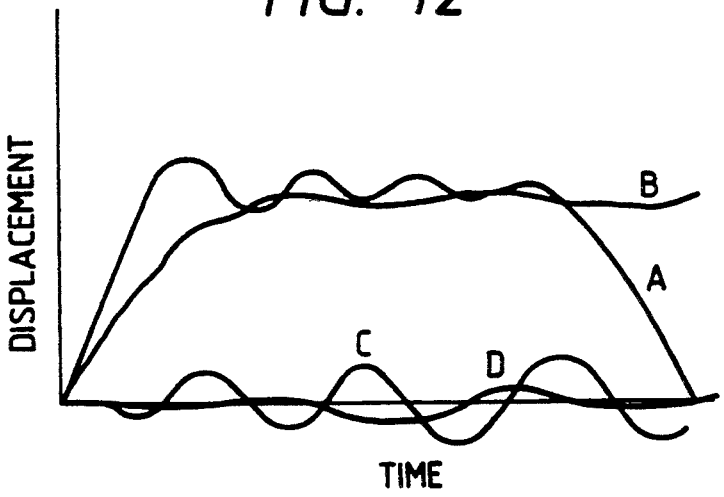
FIG. 12 is a graphical representation indicating relationships between the vibration of a pressure generating member which is driven for printing, and vibrations propagating from the pressure generating member to other pressure generating members.

As was described above, in the ink jet type recording head of the invention, the driving voltage discharge time is equal to the free vibration period dt. Therefore, the free vibration of the pressure generating member 8 becomes minimum in amplitude as indicated at (A) in FIG. 12, and therefore the amplitude of the compressional wave propagating in the substrate 9 is also made small in variation as indicated at (B) in FIG. 12. Accordingly, the resonance amplitudes of the pressure generating members $8_1$ and $8_3$ adjacent to the pressure generating member $8_2$ are suppressed as indicated at (C) and (D) of FIG. 12. That is, an erroneous operation is prevented that ink droplets are unnecessarily jetted by resonance displacement.

Furthermore, even with the plurality of pressure generating members 8 are driven simultaneously, the compressional waves produced thereby will not resonate with one another. Hence, the pressure generating members are stable in the amount of displacement and in the speed of operation irrespective of the number of the pressure generating members driven. Thus, with the driving circuit of the invention, the resultant prints are high in quality no matter what printing pattern is handled.

Figure 13:
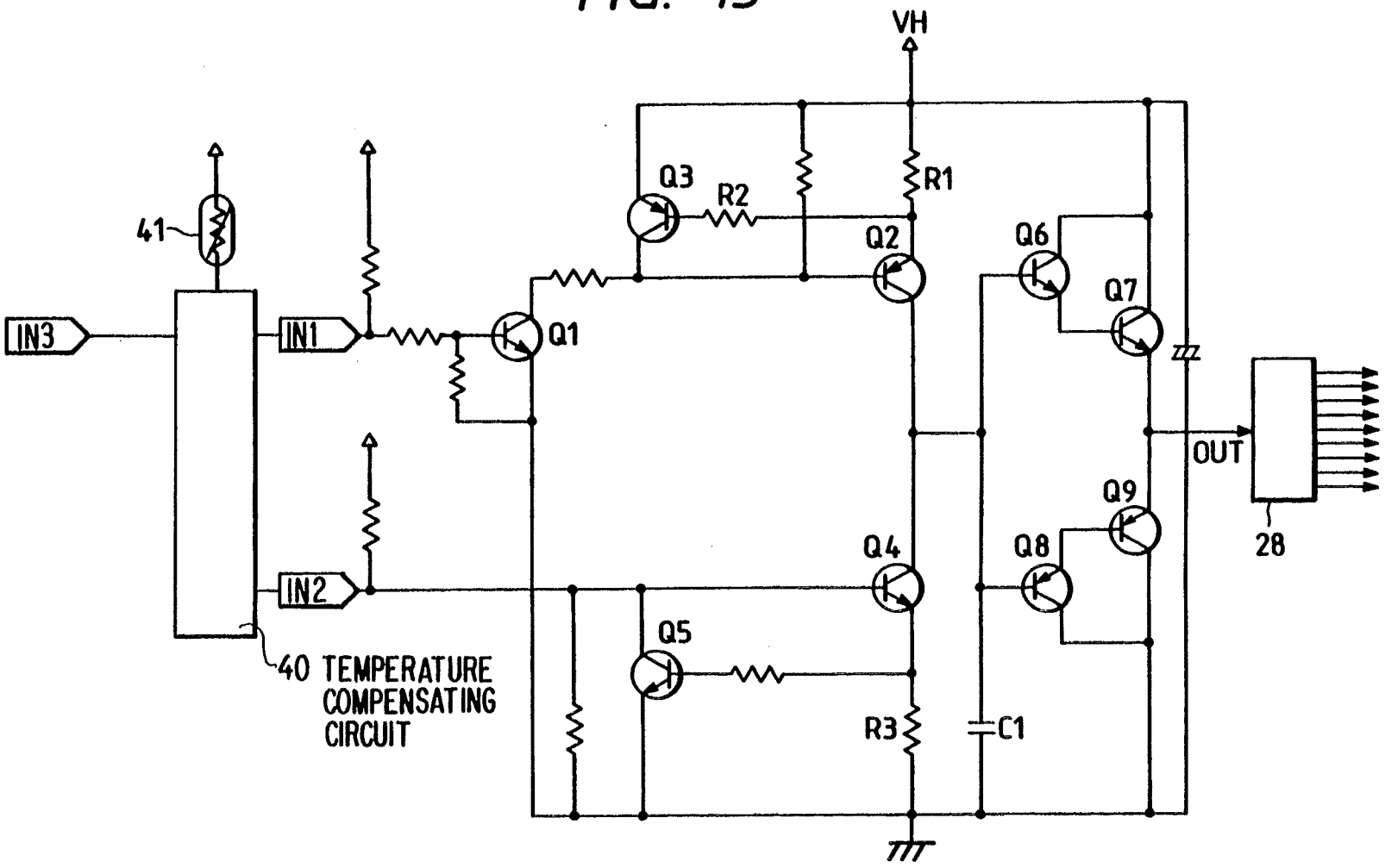
FIG. 13 is a circuit diagram, partly as a block diagram, showing the arrangement of one modification of the ink jet type recording head driving circuit shown in FIG. 1.

FIG. 13 shows on modification of the above-described ink jet type recording head driving circuit, which constitutes a second embodiment. Roughly stated, the circuit utilizes the above-described voltage adjusting function, and operates smoothly against variations in external conditions, particularly against changes in temperature.

In FIG. 13, reference numeral 40 designates a temperature compensating circuit connected between the printing timing signal input terminal IN3 and the level adjusting transistor Q1 and the switching transistor Q4. A temperature detector 41 such as a thermistor for detecting the temperature of the recording head applied a temperature signal to the temperature compensating circuit 40. In response to the temperature signal, the temperature compensating circuit 40 generates the printing preparatory signal of the pulse width Tc determined according to the temperature signal. When the time Te has passed from the fall of the printing preparatory signal in the "L" (low) level, the printing signal is generated. This operation is based on the fact that the viscosity of ink used for the ink jet type recording head is a function of temperature. That is, the circuit is so designed that the driving voltage is adjusted to compensate the reduction of the ink flying velocity which is due to the change in the viscosity of ink, thereby to change the maximum amplitude. Such a pulse-width adjusting circuit can be realized as an analog circuit by replacing an oscillation constant setting resistor of a monostable multivibrator by a thermal sensitive resistor such as a thermistor which constitutes the temperature detector 41. The circuit can be also simply realized as a digital circuit by controlling the output number of a unit pulse by a temperature signal which has been converted into digital signal through an analog-digital converter.

Figure 14:
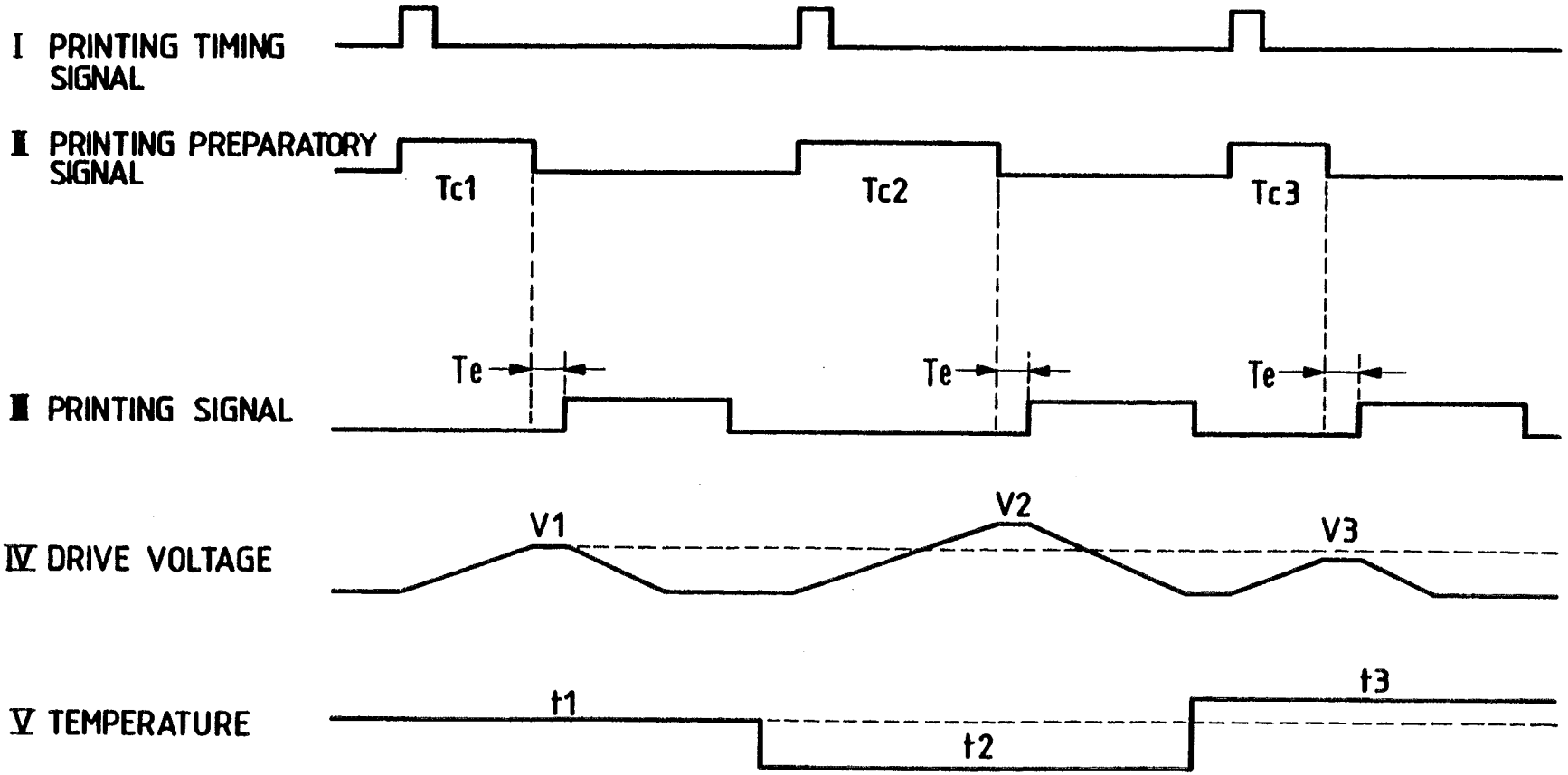
FIG. 14 is a waveform diagram for a description of the operation of the driving circuit shown in FIG. 13.

The operation of the driving circuit shown in FIG. 13 will be described with reference to a waveform diagram of FIG. 14.

It is assumed that the temperature of the ink jet type recording head is maintained at a reference value t1. In this case, a printing preparatory signal (the part II of FIG. 14) generated by the temperature compensating circuit 40 is applied to the first switching transistor Q1 as it is, without changing the pulse width Tc thereof. As a result, the capacitor C1 is charged up to a driving voltage V1 corresponding to the temperature t1 with the rise time which is determined by the resistance of the time constant adjusting resistor R1 and the capacitance of the capacitor C1 itself. The voltage of the capacitor C1 being charged is applied through the switching circuit 8 selectively to the pressure generating members 8 of the recording head, and therefore the pressure chamber 1 is stretched at a rise rate which is determined by the time constant adjusting resistor R1 and the capacitor C1, thus being expanded to a volume corresponding to the final charge voltage V1.

Thereafter, a printing signal (the part III of FIG. 14) is applied to the circuit. The printing signal turns on the second switching transistor, as a result of which the capacitor C1 is discharged at the fall rate which is determined by the capacitor C1 itself and the time constant adjusting resistor R2, so that the pressure chamber is compressed to cause the nozzle openings to jet ink droplets. In this case, since the speed of stretching the pressure generating member 8 is set to the free vibration period of the latter by the capacitor C1 and the time constant adjusting resistor R2, the residual vibration of the pressure chamber 1 is minimized as was described before.

When the ink droplet flying velocity is decreased for instance because the temperature of the recording head is decreased to a value t2 from the designed reference value t1 to increase the viscosity of ink, the temperature compensating circuit 40 operates to increase the pulse width of the printing preparatory signal applied to the input terminal IN1 from TC1 to TC2. The printing preparatory signal thus processed is applied to the first switching transistor Q2. As a result, the capacitor C1 is charged to the voltage v2 higher than the reference voltage V1. Needless to say, the rate of change in the voltage of the capacitor being charged is maintained at a predetermined value which is determined by the capacitor C1 and the time constant adjusting resistor R1, and therefore the meniscus is held at the nozzle opening 6 as it is.

Thereafter, in a predetermined period of time, a printing signal is applied to turn on the switching transistor Q4, so that the capacitor C1 is discharged. That is, the voltage V2 is decreased with the fall time which is determined by the time constant adjusting resistor R2 and the capacitor C1, and accordingly the pressure chamber is contracted in synchronization with the decrease of the voltage V2. In this case, the pressure chamber 1 has been expanded larger than in the case where the recording head is at the designed reference temperature t1, and therefore a high pressure is produced in the pressure chamber, so that ink droplets fly at the designed reference velocity against the fluid resistance which is provided as the ink is increased in viscosity.

When the temperature of the recording head is raised to t3, then the temperature compensating circuit 40 operates to change the pulse width of the printing preparatory signal to a value Tc3 corresponding to the temperature t3, so that the pressure generating member is contracted with a voltage V3. As a result, a pressure is produced in accordance with a reduction in the viscosity of ink which is due to the rise of temperature of the recording head, so that the ink droplets fly at the designed reference velocity. That is, the pressure chamber 1 is changed both in volume and in contraction rate according to the temperature of the recording head, and therefore ink droplets are produced in the predetermined manner irrespective of changes in temperature.

In the above-described embodiment, the printing preparatory signal having the most suitable pulse width Tc1 at the reference temperature is processed to have a pulse width corresponding to a current temperature in response to the detection signal from the temperature detecting means. However, this may be modified as follows: That is, relationships between temperatures of the ink jet type recording head and pulse widths of the printing preparatory signal are detected in advance, and are stored, as data, in a memory. In response to the detection signal from the temperature detecting means, the corresponding pulse width is read from the memory, so that a printing preparatory signal having the pulse width thus read is outputted in synchronization with the printing timing signal. It goes without saying that the modification provides the same effects.

As was described above, in the ink jet type recording head driving circuit of the invention, the capacitor is connected through the first switching element and the charging time constant adjusting resistor to an electric power source, and grounded through the second switching element and the discharging time constant adjusting resistor, the terminal voltage of the capacitor is outputted through the current buffer, and the first pulse for contracting the piezo-electric vibrator is applied to the first switching element, and the second pulse for expanding the piezo-electric vibrator is applied to the second switching element. Hence, the speed of contraction of the pressure generating member at the time of expansion of the pressure chamber, and the speed of contraction of the pressure generating member at the time of flight of the ink droplet can be individually set respectively to a value with which the meniscus is not moved, and to a value with which no residual vibration occurs. Furthermore, by changing the pulse width of the first pulse, the conditions of formation of ink droplets can be made constant against variations in external condition and in supply voltage.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An ink jet type recording head driving circuit, comprising:

a first switching element which is controlled by a first pulse for contracting a piezo-electric vibrator;

a second switching element which is controlled by a second pulse for expanding said piezo-electric vibrator;

a charge time constant adjusting resistor;

a discharging time constant adjusting resistor connected in series with said second switching element;

a capacitor connected exclusively to an electric power source through said first switching element and said charge time constant adjusting resistor and to ground through said second switching element and said discharging time constant adjusting resistor, wherein a rate of contraction of said piezo-electric vibrator is controlled by a time constant determined by said charge time constant adjusting resistor and said capacitor, and wherein a rate of expansion of said piezo-electric vibrator is controlled by a time constant determined by said discharging time constant adjusting resistor and said capacitor; and a current buffer, coupled to said capacitor and to a common connection point between said first switching element and said second switching element, for supplying a terminal voltage of said capacitor to said piezo-electric vibrator.

2. A driving circuit as claimed in claim 1, in which said first pulse signal is set with time for determination of a voltage value to be applied to said piezo-electric vibrator.

3. A driving circuit as claimed in claim 1, further comprising temperature compensating means for changing a pulse width according to external temperature, through which said first pulse signal is applied to said first switching element.

4. A driving circuit as claimed in any one of claims 1 to 3, in which said charge time constant adjusting resistor has a resistance such that when said piezo-electric vibrator contracts a pressure chamber coupled to said piezo-electric vibrator expands in such a manner as not to retract a meniscus at a nozzle opening associated with said pressure chamber.

5. A driving circuit as claimed in any one of claims 1 to 3, in which said discharging time constant adjusting resistor has a resistance such that a discharging time constant is substantially equal to a period of free vibration of said piezo-electric vibrator.

6. A driving circuit as claimed in claim 1, wherein a resistance value of said charge time constant adjusting resistor is changeable for determination of a voltage value to be applied to said piezo-electric vibrator.

7. An ink jet type recording head driving circuit, comprising:

a first constant current circuit for adjusting a charge time constant, said first constant current circuit comprising a first switching element controlled by a first pulse for contracting a piezo-electric vibrator, and a charge time constant adjusting resistor shunted with a first constant current transistor;

a second constant current circuit for adjusting a discharge time constant, said second constant current circuit comprising a second switching element controlled by a second pulse for expanding said piezo-electric vibrator, and a discharge time constant adjusting resistor which is shunted with a second constant current transistor; and a capacitor connected at one terminal thereof through said first switching element and said charging time constant adjusting resistor to an electric power source and connected to ground at the other terminal, said capacitor being connected in parallel to said second switching element and said discharging time constant adjusting resistor.

* * * * *